US006212916B1

(12) United States Patent
Carr

(10) Patent No.: US 6,212,916 B1
(45) Date of Patent: Apr. 10, 2001

(54) DRY CLEANING PROCESS AND SYSTEM USING JET AGITATION

(75) Inventor: Robert B. Carr, Brookline, MA (US)

(73) Assignee: Sail Star Limited, Causeway Bay (HK)

( * ) Notice: Subject to any disclaimer, the term of this patent is extended or adjusted under 35 U.S.C. 154(b) by 0 days.

(21) Appl. No.: 09/266,145

(22) Filed: Mar. 10, 1999

(51) Int. Cl.[7] ..... D06F 43/08
(52) U.S. Cl. ..... 68/18 R
(58) Field of Search ..... 8/158, 142; 68/18 R, 68/18 C; 134/10, 12, 107

(56) References Cited

U.S. PATENT DOCUMENTS

| | | | |
|---|---|---|---|
| 400,441 | 4/1889 | Cooper . | |
| 2,161,208 | 6/1939 | Soderholm | 8/159 |
| 2,219,490 | 10/1940 | Pisarev | 8/111 |
| 3,969,196 | 7/1976 | Zosel | 203/49 |
| 4,012,194 | 3/1977 | Maffei | 8/142 |
| 5,013,366 | 5/1991 | Jackson et al. | 134/1 |
| 5,123,176 | 6/1992 | Yamada et al. | 34/32 |
| 5,267,455 | 12/1993 | Dewees et al. | 68/5 |
| 5,279,615 | 1/1994 | Mitchell et al. | 8/142 |
| 5,316,591 | 5/1994 | Chao et al. | 134/34 |
| 5,339,844 | 8/1994 | Stanford, Jr. et al. | 134/107 |
| 5,412,958 | 5/1995 | Iliff et al. | 68/5 |
| 5,456,759 | 10/1995 | Stanford, Jr. et al. | 134/1 |
| 5,467,492 | 11/1995 | Chao et al. | 8/159 |
| 5,669,251 | 9/1997 | Townsend et al. | 68/58 |
| 5,759,209 | 6/1998 | Adler et al. | 8/142 |
| 5,858,022 | 1/1999 | Romack et al. | 8/142 |
| 5,904,737 | 5/1999 | Preston et al. | 8/158 |
| B1 4,219,333 | 2/1984 | Harris | 8/137 |

FOREIGN PATENT DOCUMENTS

| | | |
|---|---|---|
| 2027003 | 12/1971 | (DE) . |
| 3904513 A1 | 8/1990 | (DE) . |
| 4004111 A1 | 8/1990 | (DE) . |
| 3906724 C2 | 3/1998 | (DE) . |
| 3904514 C2 | 3/1999 | (DE) . |
| 3906735 C2 | 4/1999 | (DE) . |
| 0518653 B1 | 9/1995 | (EP) . |
| 0530949 B1 | 9/1995 | (EP) . |
| WO 90/06189 | 6/1990 | (WO) . |

*Primary Examiner*—Philip R. Coe
(74) *Attorney, Agent, or Firm*—Weingarten, Schurgin, Gagnebin & Hayes LLP

(57) ABSTRACT

A dry-cleaning process for cleaning articles disposed in a cleaning chamber having jet inflow ports, using carbon dioxide ($CO_2$) from first and second storage tanks, the process including the steps of compressing gaseous $CO_2$ into the first storage tank to cause a positive pressure differential between the first storage tank and the cleaning chamber, filling the cleaning chamber with liquid carbon dioxide by enabling $CO_2$ flow from the first storage tank to the cleaning chamber in response to the positive pressure differential, alternately compressing gaseous $CO_2$ into the first or second storage tanks to cause a pressure differential between the first and second storage tanks, and flowing liquid $CO_2$ between the first and second storage tanks, via the jet ports and through the cleaning chamber, in response to the pressure differential between the first and second storage tanks, to provide jet agitation in the cleaning chamber and a periodically continuous flow of liquid $CO_2$ through the cleaning chamber.

8 Claims, 12 Drawing Sheets

DRY CLEANING PROCESS AND SYSTEM USING JET AGITATION

FIELD OF THE INVENTION

The present invention relates to dry cleaning processes in general and, more particularly, to a dry cleaning process and system using a pressurized dense-phase gas such as carbon dioxide.

BACKGROUND OF THE INVENTION

Dry cleaning processes using pressurized carbon dioxide ($CO_2$) are well known in the art. Dry cleaning systems using liquid/supercritical dense-phase gas such as carbon dioxide are described, inter alia, in U.S. Pat. Nos. 5,267,455 and 5,412,958, 5,316,591, 4,012,194, 5,013,366, 5,456,759 and 5,339,844. In such systems, pressurized liquid $CO_2$ is pumped from a reservoir into a cleaning chamber, where articles to be cleaned, e.g., clothes, are suspended in the liquid $CO_2$. Agitating of the articles and/or the $CO_2$ in the cleaning chamber provides the mechanical action required for cleaning. Some prior art systems use a mechanical rotation mechanism to provide the agitation necessary for cleaning. Other prior art systems use a plurality of injection ports to inject high-pressure liquid $CO_2$ jets into the cleaning chamber and, thereby, to provide the agitation necessary for cleaning.

Liquid $CO_2$ may be injected into the cleaning chamber via different sets of injection ports to provide agitation and, consequently, rotation of the articles within the cleaning chamber, in either a clockwise or counter-clockwise direction. In a standard $CO_2$ dry-cleaning process, the articles are alternately rotated in either direction by periodically stopping the injection through a first set of injection ports and resuming injection of the liquid $CO_2$ through a second set of injection ports that are positioned to inject the liquid $CO_2$ in a direction opposite that of the first set of ports. During the injection process, the continuous supply of liquid $CO_2$ forces the liquid $CO_2$ in the chamber to be continuously displaced out of the cleaning chamber and returned to the storage tank. After a desired number of agitation cycles are completed, the cleaning chamber is drained and the liquid $CO_2$ is transported back into the storage tank. A heavy-duty positive displacement piston pump is typically used to circulate the liquid $CO_2$ throughout the system, e.g. to provide a substantially continuous flow of liquid $CO_2$ through the cleaning chamber during agitation.

The use of such a pump has a number of disadvantages that render prior art systems complex and/or cost-inefficient for many applications. One disadvantage is that the pump is a relatively expensive element of the dry cleaning system. Another disadvantage is that the pump requires a net positive suction head ("NPSH"). This head is generated by both the fluid level in whatever vessel is to be drained and the elevation of the vessel relative to the pump inlet. Configurations that provide adequate pressure such as tall vessels or mounting the vessel about the pump are not desirable because they result in a large machine. Furthermore, completely draining the cleaning chamber still may be difficult because NPSH decreases as the chamber empties.

Another prior art method of providing adequate pump head is by using a distillation chamber. Gas is heated in the chamber, and the resultant pressure increase is used to provide NPSH. However, the use of such distillation chamber adds complexity and cost to the system.

Furthermore, the pump is susceptible to damage and wear from dirt suspended in the fluid, which reduces pumping efficiency. Filters cannot be used on the suction side of the pump because they decrease the pressure at the pump inlet, adding to the problem of attaining adequate positive pressure head. Thus, in addition to equipment and operating costs, frequent maintenance is also necessary.

SUMMARY OF THE INVENTION

It is an object of the present to provide a process and a system for efficiently supplying and recycling and draining liquid carbon dioxide ($CO_2$) in a dry cleaning system using jet agitation. In accordance with an embodiment of the present invention, pressurized liquid $CO_2$ is circulated throughout the dry cleaning system, specifically, liquid $CO_2$ is moved between one or two storage tanks and a cleaning chamber of the dry cleaning system, by means of pressure differentials produced between the storage tanks and the cleaning chambers, obviating the need for a pump. In an embodiment of the present invention, the pressure differentials are produced by a gas compressor which does not directly interact with liquid $CO_2$ and, thus, does not accumulate dirt suspended in the liquid $CO_2$. This eliminates the problems associated with pumps used by prior art systems, making the system of the present invention more cost effective and reliable.

In an embodiment of the present invention, the compressor may draw gaseous $CO_2$ from the cleaning chamber and inject it into one of the storage tanks, or vice versa, to create either a positive or a negative pressure differential, respectively, between the storage tank and the cleaning chamber. A positive pressure differential enables flow of liquid $CO_2$ from the storage tank to the cleaning chamber via jet ports, e.g., to fill the chamber. A negative pressure differential enables flow of liquid $CO_2$ from the cleaning chamber to the storage tank, e.g., to drain the cleaning chamber. The compressor may also draw gaseous $CO_2$ from one storage tank and inject it to the other storage tank to create a pressure differential between the two storage tanks. This pressure differential enables flow of liquid $CO_2$ between the two storage tanks via the cleaning chamber, to provide jet agitation within the cleaning chamber. The magnitude of the pressure differential may be controlled by varying the speed of the compressor motor or using a throttle valve.

In an embodiment of the present invention, first and second storage tanks are used to alternately supply liquid $CO_2$ to the cleaning chamber, thereby maintaining a periodically continuous flow of liquid $CO_2$ through the cleaning chamber. The flow of liquid $CO_2$ may be stopped periodically during the agitation cycle to switch between the first and second storage tanks being used for liquid $CO_2$ supply.

The dry cleaning process of the present invention may also include a method of recovering heat from the compressed gas. In a vapor recovery step of the dry cleaning process, as described below, heat from the gaseous $CO_2$ is transferred to a heat sink, which may be in the form of heat exchanger immersed in a water bath, before cooling the $CO_2$ by a refrigeration system. This reduces the amount of energy consumed by the refrigeration system. The heat energy stored in the heat sink may subsequently be used to heat cold gas during a cleaning chamber warm-up step of the dry cleaning process, as described below, obviating or reducing the need for additional heating. Thus, the present invention utilizes a heat recovery cycle which improves the cost-efficiency of the dry cleaning process.

Except for specific aspects of the present invention, as described herein, the process and system of the invention are compatible with existing dry cleaning processes and systems and may be used in conjunction with any cleaning chamber and/or baskets and/or other parts of dry cleaning systems that are known in the art.

A dry-cleaning system in accordance with an embodiment of the present invention includes a cleaning chamber, which may include a basket, having jet inflow ports and a pressure containment sufficient to keep $CO_2$ in a liquid state, first and second storage tanks for storing $CO_2$ at a predetermined pressure, and means for providing a pressure differential between the first and second storage tanks and/or between the cleaning chamber and either the first or second storage tanks. In some embodiments, the system may further include a vapor heat exchange/recovery system, a refrigeration system, a filtration system, and a cleaning chamber ventilation system. The pressure differentials between the storage tanks and the cleaning chamber is preferably produced by a gas compressor, such as an oil-less compressor. The system may also include a heater to keep the heat sink water tank above a minimum temperature, a muffler for final venting of cleaning vessel, a lint trap and a filter.

A dry cleaning process in accordance with an embodiment of the present invention may include at least some of the following steps:

(a) Removing moisture laden air and reducing the amount of water dissolved in the $CO_2$. In this step, the compressor may act as a vacuum pump to evacuate moisture-laden air from the cleaning chamber to the outside environment.

(b) Equalizing pressure between the storage tanks and the cleaning chamber in a controlled fashion to avoid clothes damage. In this step, $CO_2$ gas may flow from the storage tanks to the cleaning chamber through appropriate valves, until the pressure difference between the cleaning chamber and the tank drops below a predetermined threshold.

(c) Filling the cleaning chamber with liquid $CO_2$ from the first or second storage tank. In this step, $CO_2$ vapor is drawn from the top of the cleaning chamber by the compressor and is compressed into the top of one of the storage tanks, preferably the storage tank having a higher fluid level. This creates a pressure differential sufficient to force liquid $CO_2$ out of the bottom of the storage tank into the bottom of the cleaning chamber until the cleaning chamber is completely full.

(d) Agitating the articles being cleaned by injecting liquid $CO_2$ through the jet ports causing rotation of the articles within the chamber. In this step, the compressor alternately draws $CO_2$ vapor from the top of the first or second storage tank and compresses the vapor into the top of the other storage tank. This creates a pressure differential between the first and second storage tanks sufficient to force liquid $CO_2$ out of the bottom of the compressed storage tank and into the cleaning chamber. The liquid $CO_2$ enters the cleaning chamber via the jet ports which are preferably positioned to provide agitation in a given direction, e.g., clockwise. Because the cleaning chamber is full, liquid $CO_2$ is displaced out of the cleaning chamber and is recycled back into the decompressed storage tank, optionally via filters and lint traps as are known in the art. The flow of liquid $CO_2$ in this direction may continue until the fluid level in the compressed storage tank drops below a predetermined threshold, or for a predetermined time period. Then, the direction of compression is reversed and agitation is resumed by flowing liquid $CO_2$ from the other storage tank into the cleaning chamber, preferably via a second set of jet ports, thereby providing agitation in an opposite direction, e.g., counter-clockwise. These alternate agitation cycles may be repeated a predetermined number of times to provide sufficient agitation.

(e) Draining used/contaminated liquid from the cleaning chamber. In this step, gaseous $CO_2$ is drawn from the top of the last-emptied storage tank and is compressed into the top of the cleaning chamber, forcing liquid out of the bottom of the cleaning chamber into the bottom of the last-emptied storage tank. This drainage is continued until the cleaning chamber is completely empty.

(f) Recovering $CO_2$ vapor remaining in the cleaning chamber after drainage. In this step, $CO_2$ vapor may be drawn from the top of the cleaning chamber and pushed by the compressor, through the water bath and/or refrigeration system which cools and condenses the vapor into liquid, back into the first and/or second storage tanks.

(g) Heating the cleaning chamber to prevent water ice formation on the articles being cleaned. In this step, the compressor draws cold $CO_2$ vapor from the cleaning chamber and pushes the vapor, via the water bath which heats the vapor, back to the cleaning chamber. Once the cleaning chamber is sufficiently warm, vapor recovery may be resumed.

(h) Venting the cleaning chamber to remove any remaining $CO_2$ pressure such that a door of the cleaning chamber may be opened and the clean articles removed. In this step, $CO_2$ vapor may flow out of the cleaning chamber, optionally via a sound control muffler, to the external environment.

BRIEF DESCRIPTION OF THE DRAWINGS

The present invention will be understood and appreciated more fully from the following detailed description of a preferred embodiment of the invention, taken in conjunction with the following drawings of which.

DETAILED DESCRIPTION OF THE INVENTION

Figure 1:
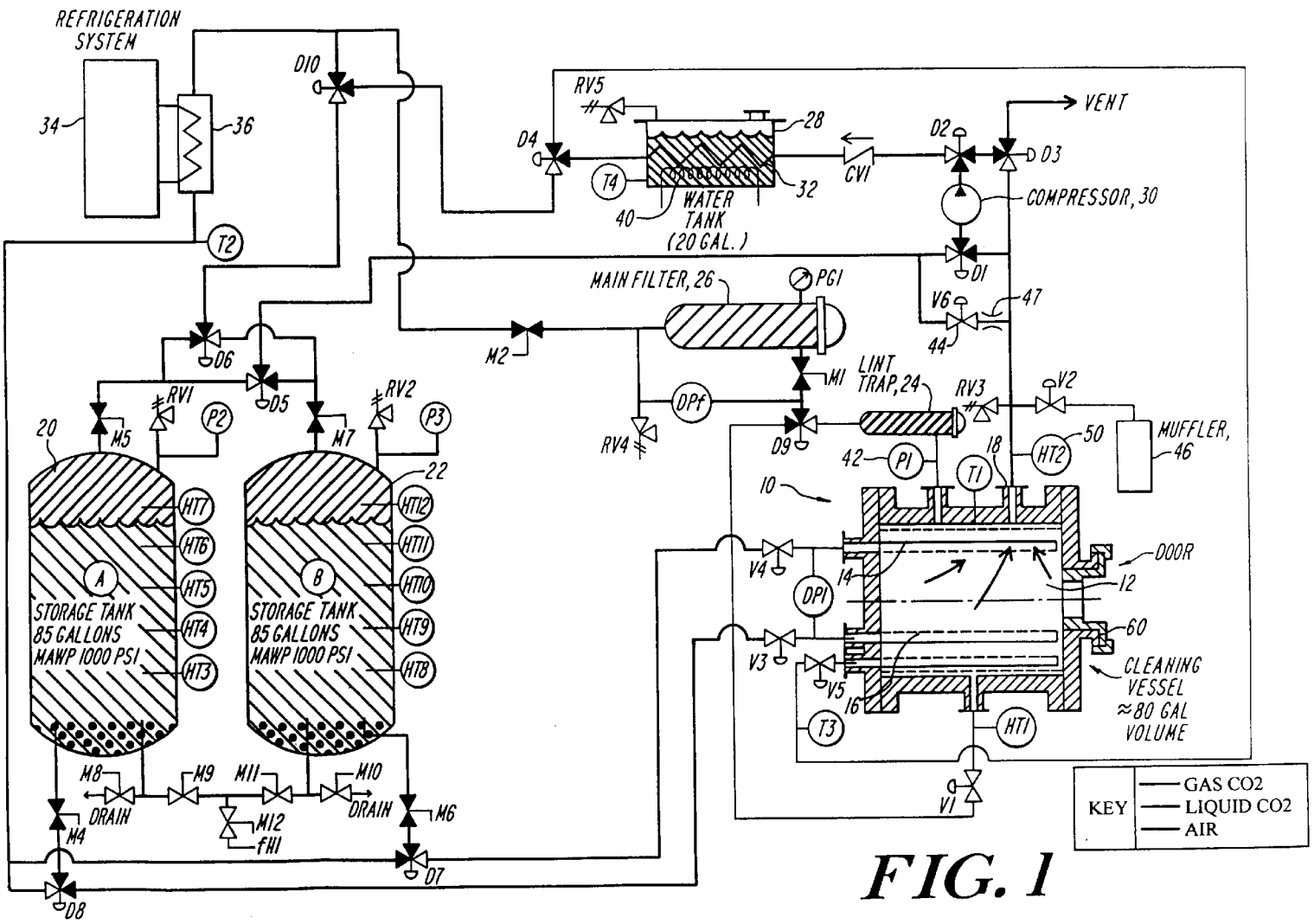
FIG. 1 is a schematic illustration of a dry-cleaning system during an air evacuation step of a dry-cleaning process in accordance with an embodiment of the present invention.

Reference is now made to FIGS. 1–9 which schematically illustrates a dry-cleaning system in accordance with an embodiment of the present invention during various stages of a dry-cleaning process in accordance with an embodiment of the present invention. The system includes a cleaning chamber 10, for example an 80 gallon cleaning chamber, having a basket 12 for holding articles to be cleaned and jet inflow port arrangements 14 and 16. In an embodiment of the present invention, each of port arrangements 14 and 16 includes a plurality of hollow wands, each wand having a plurality of apertures through which liquid $CO_2$ may flow into cleaning chamber 10 in a predetermined direction. For example, each of port arrangements 14 and 16 may include two hollow, diametrically opposite, wands, each having 10–20 jet ports (e.g., apertures) which are oriented to provide liquid $CO_2$ inflow in a predetermined direction, e.g., clockwise or counterclockwise. In an embodiment of the present invention, as described in detail below, port arrangements 14 and 16 are designed to provide liquid $CO_2$ jet agitation in opposite directions, e.g., the ports of arrangement 14 may be oriented to provide clockwise jet agitation while the ports of arrangement 16 may be oriented to provide counter-clockwise jet agitation, or vice versa.

Cleaning chamber 10 is preferably designed to have high pressure containment capability, for example, a pressure containment of 1,100 PSI, sufficient to maintain carbon dioxide ($CO_2$) in a liquid state. The system further includes first and second storage tanks, 20 and 22, respectively, having predetermined volume capacity, for example, 100 gallons each. Tanks 20 and 22 preferably have high pressure containment capability, for example, 1,100 PSI, and include predetermined initial amounts of $CO_2$ at a predetermined pressure. In a preferred embodiment of the invention, the system also includes a lint trap 24, for example, a 100 mesh lint trap as is known in the art, and a filter 26, for example, a 40 micron filter as is known in the art.

In accordance with the present invention, the system includes means for providing a pressure differential between storage tanks 20 and/or 22 and/or cleaning chamber 10. In an embodiment of the present invention, the desired pressure differential is provided by a gas compressor 30, preferably an oil-less compressor. An important advantage of using a gas compressor such as compressor 30, rather than a liquid pump (as used in prior art systems), is that gas flow does not suspend dirt and, thus, dirt is not carried into the compressor. This reduces wear and, consequently, operating and maintenance costs of the dry cleaning system.

Compressor 30 is preferably capable of producing partial vacuum duty and vapor recovery. In an embodiment of the present invention, compressor 30 is capable of decreasing the pressure in cleaning chamber 10 to less than 400 PSI, preferably less than 150 PSI, for example about 50 PSI. It should be appreciated that a low pressure in chamber 10 minimizes wastage of $CO_2$ during venting of the cleaning chamber, as described below. Further, in an embodiment of the present invention, compressor 30 is capable of increasing the pressure in either or both of storage tanks 20 and 22 to more than 750 PSI, preferably more than 850, for example, 900 PSI.

It should be appreciated that a high pressure in storage tanks 20 and/or 22 maintains the $CO_2$ in liquid state with minimal cooling and, therefore, results in more energy-efficient dry cleaning. The magnitude of the pressure differential produced between storage tanks 20 and/or 22 and/or cleaning chamber 10 may be controlled by varying the motor speed of compressor 30 or using a throttle valve, as is known in the art. An example of an oil-less compressor that may be used in conjunction with the present invention to provide the above described parameters is the Blackmer HDL 322 oil-less compressor, available from Blackmer, Inc., Oklahoma City, Okla.

The system preferably further includes a water bath 28 associated with a heat exchanger 32, which act as a heat sink for heat storage and transfer, and a refrigeration system with heat exchanger 36 adapted for cooling $CO_2$. An electric heater 40 is preferably installed in water bath 28 to maintain a predetermined temperature in the bath, for example, 80° C., during idle periods of the dry-cleaning process. When cold $CO_2$ from the cleaning chamber is transported through the heat exchanger, as described below, the temperature in the water bath drops because heat is transferred to the $CO_2$. As clearly shown in the drawings, the dry cleaning system includes piping as necessary for connecting between the different system elements of the system various valves for controlling the operation of the system during different steps of the dry cleaning process. Some of these valves are specifically discussed below with reference to steps of the dry cleaning method of the present invention, however, the function of most of these valves will be apparent to persons of ordinary skill in the art of dry-cleaning systems. The system further includes a sound control muffler 46 which may be used during final venting of cleaning chamber 10, as described below.

Figure 9:
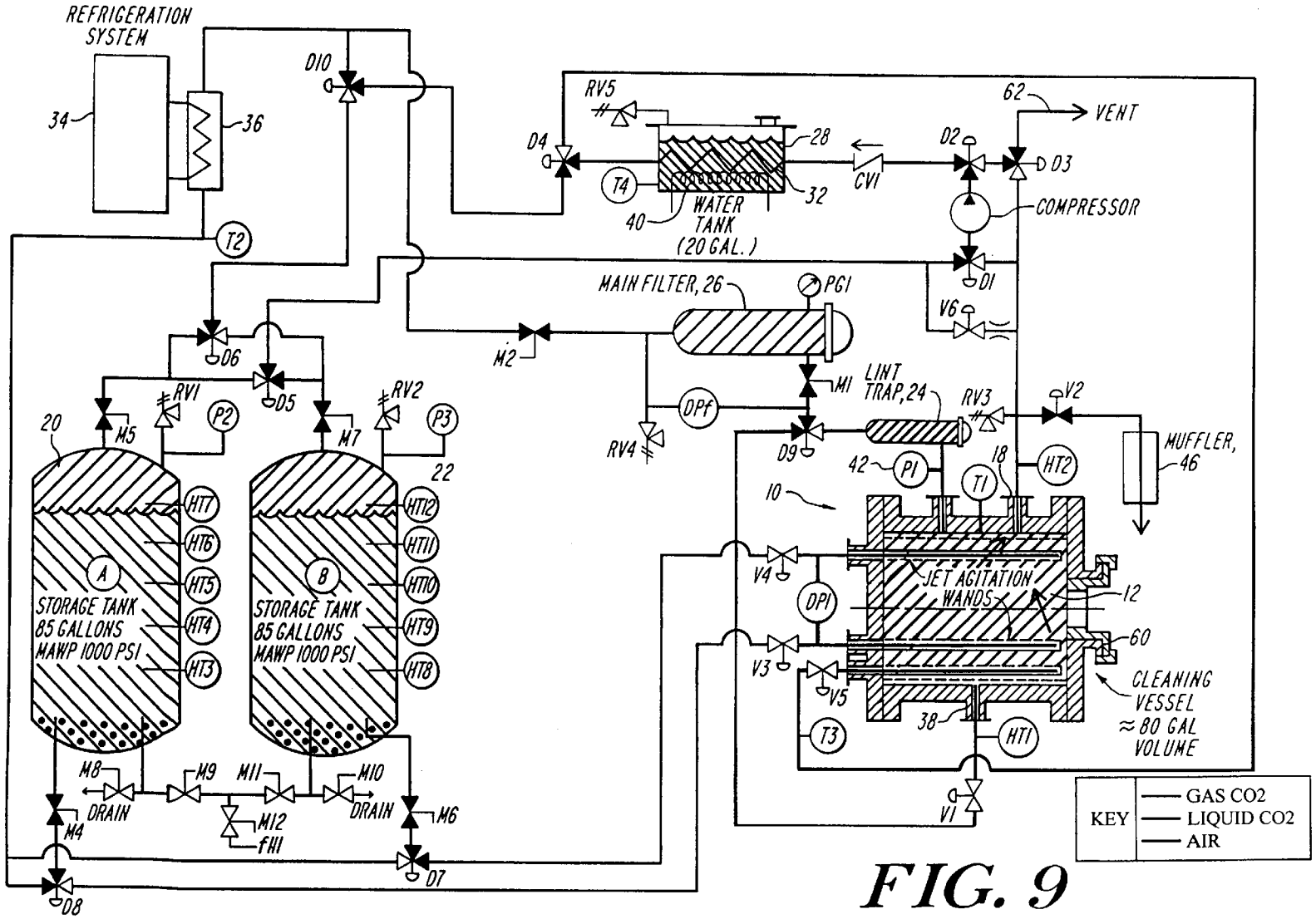
FIG. 9 is a schematic illustration of the system of FIG. 1 during a cleaning chamber ventilation step of a dry-cleaning process in accordance with an embodiment of the present invention.
Figure 10:
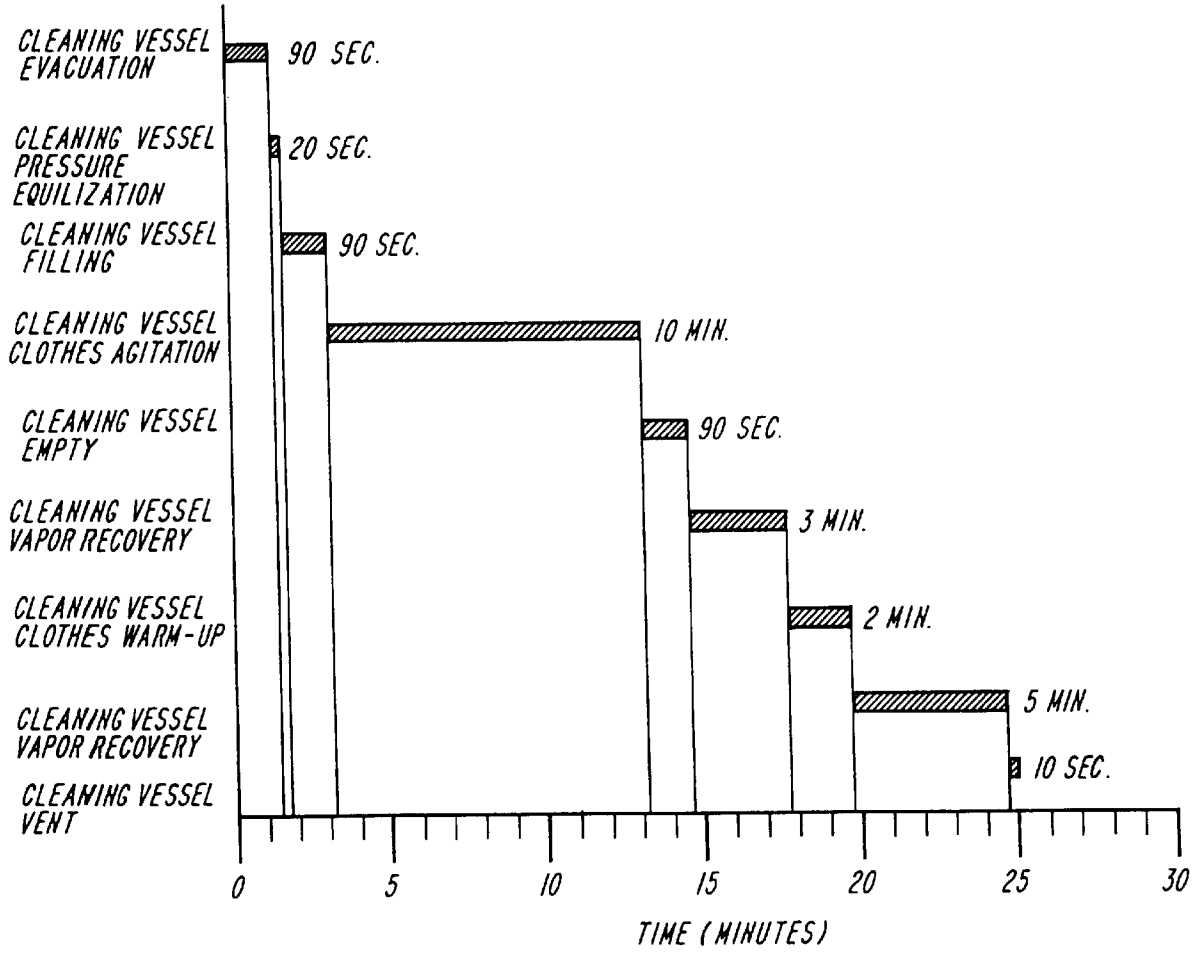
FIG. 10 is a schematic graphic representation of a dry-cleaning process sequence in accordance with an embodiment of the present invention.

Reference is now made also to FIG. 10 which schematically illustrates the different steps of a dry cleaning process according to an embodiment of the present invention, showing exemplary length of time for each step. FIG. 10 is self-explanatory to a person skilled in the art. A detailed description of the different steps of the dry cleaning according to an embodiment of the present invention is provided below with reference to FIGS. 1–9.

FIG. 1 illustrates an air evacuation step of the dry-cleaning process in accordance with an embodiment of the present invention. The purpose of this step is to remove moisture laden air and, thus, to reduce the amount of water dissolved in the $CO_2$. Compressor 30 acts as a vacuum pump with respect to cleaning chamber 10. The compressor is activated for a predetermined time period, for example about 2 minutes, until a predetermined pressure is reached, for example, 20–25 inches Hg, as determined by a pressure transducer 42. Once the desired pressure level is reached, compressor 30 is shut down.

Figure 2:
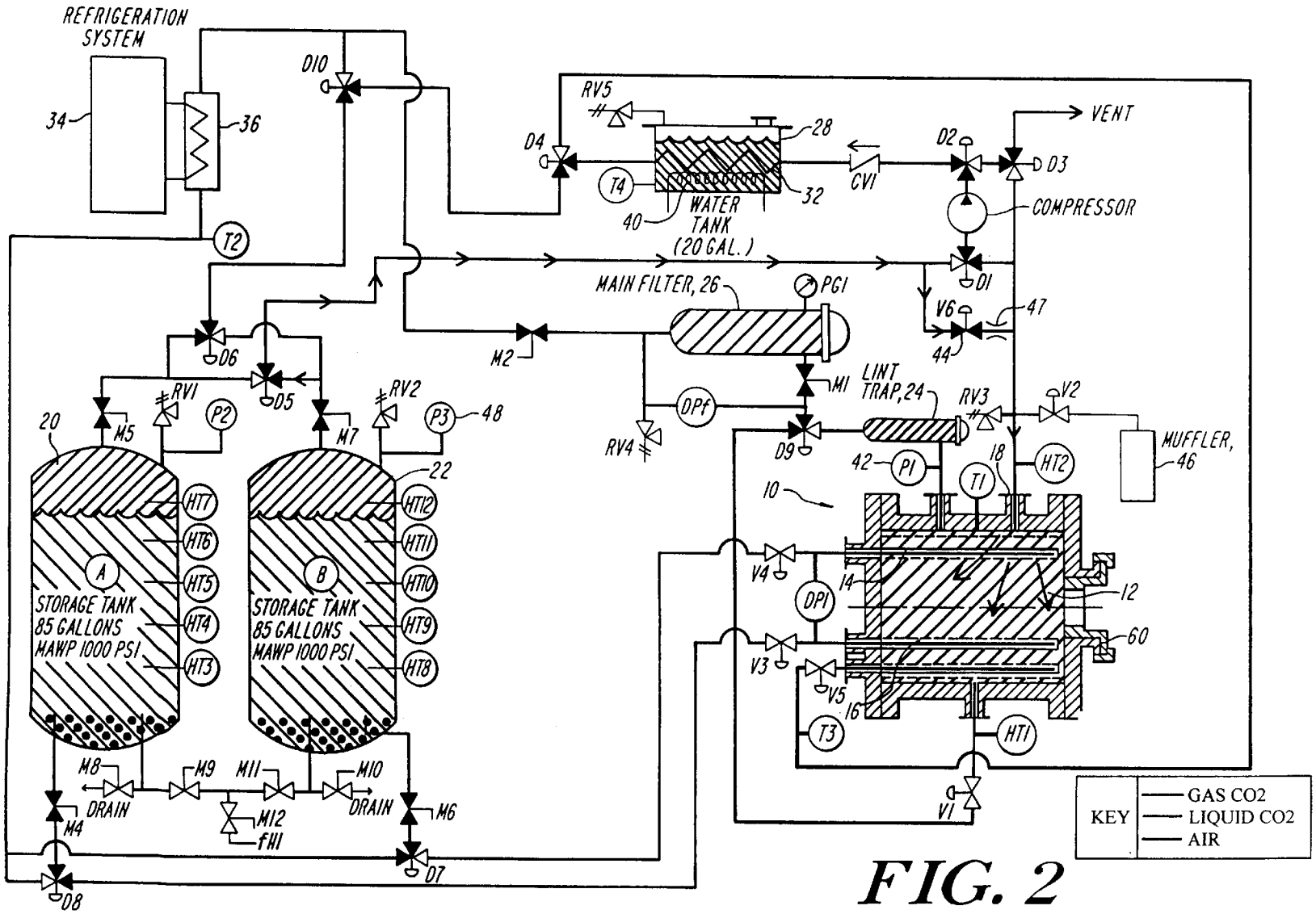
FIG. 2 is a schematic illustration of the system of FIG. 1 during a pressure equalization step of a dry-cleaning process in accordance with an embodiment of the present invention.

FIG. 2 schematically illustrates a pressure equalization step of the dry-cleaning process in accordance with an embodiment of the present invention. During this step, the pressure between storage tanks 20 and/or 22 and cleaning chamber 10 is equalized in a controlled fashion to avoid damage to the articles being cleaned. Gaseous $CO_2$ flows from the top of the storage tank to the top of the cleaning chamber through a valve 44 and an orifice 47 until the difference between the readings of pressure transducer 42 and a pressure transducer 48 is under a predetermined threshold, for example a 10 percent difference.

Figure 3:
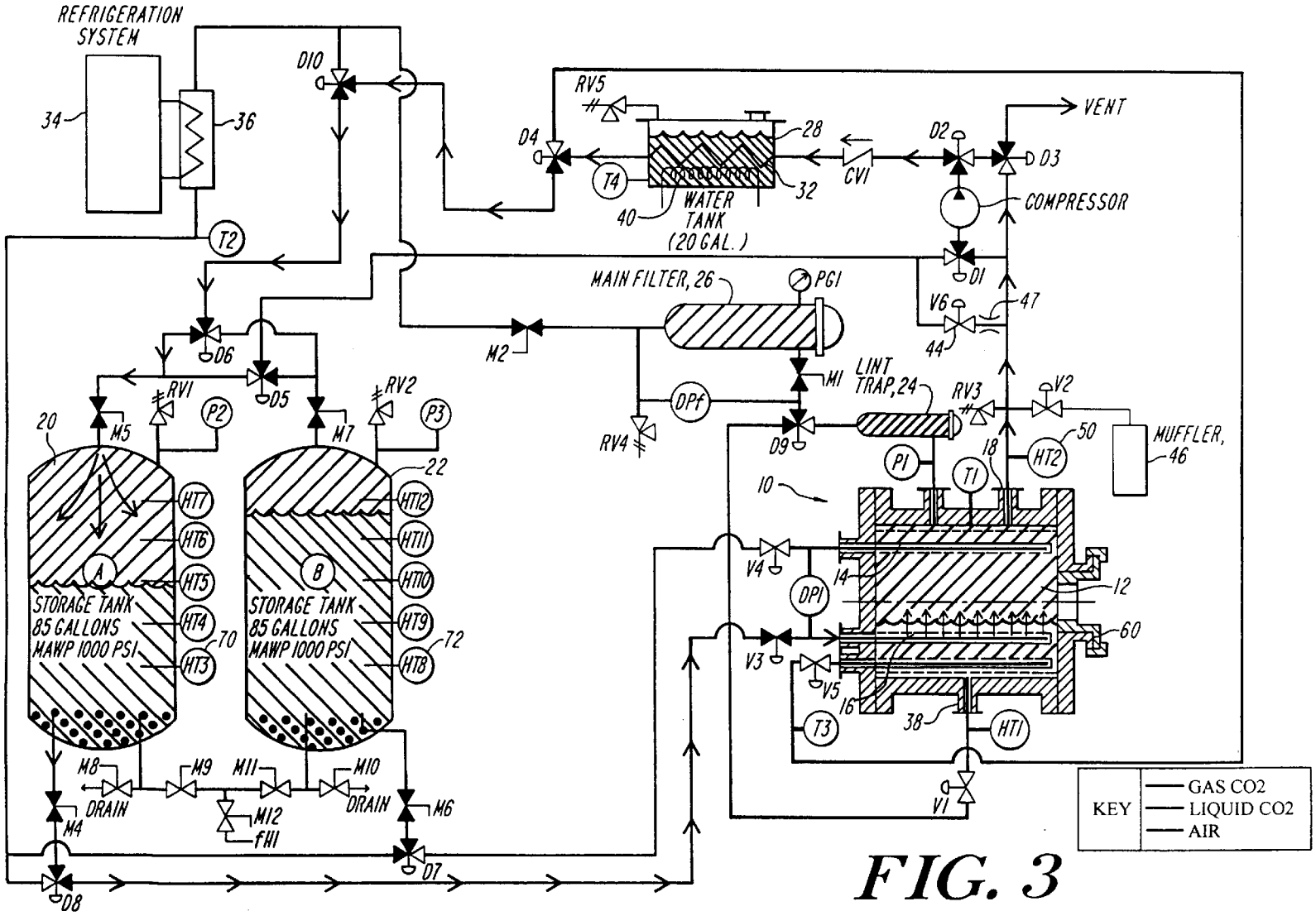
FIG. 3 is a schematic illustration of the system of FIG. 1 during a cleaning chamber filling step of a dry-cleaning process in accordance with an embodiment of the present invention.

After pressure equalization is reached, cleaning chamber 10 may be filled with $CO_2$ from either storage tank 20 or storage tank 22, both of which are full at this stage of the process. FIG. 3 schematically illustrates a step of filling cleaning chamber 10 with liquid $CO_2$ from storage tank 20. In this step, gaseous $CO_2$ is drawn from a top opening 18 of cleaning chamber 10 and is pushed by compressor 30 into the top of storage tank 20. Thus, compressor 30 produces a positive pressure differential between storage tank 20 and cleaning chamber 10, enabling flow of liquid $CO_2$ from storage tank 20 to cleaning chamber 10. Although heating of the $CO_2$ is not required at this stage of the process, the $CO_2$ flows through heat exchanger 32 in water bath 28, thus utilizing the same piping scheme for different stages of the process. In response to the positive pressure differential, liquid $CO_2$ flows out of the bottom of storage tank 20 into a bottom opening 38 of cleaning chamber 10, until the cleaning chamber is completely filled with liquid $CO_2$. This may be determined by a timer (not shown) and/or by a sensor 50 which detects the presence of liquid $CO_2$ as it exits cleaning chamber 10 and/or by a level sensor 70 associated with storage tank 20.

Figure 4:
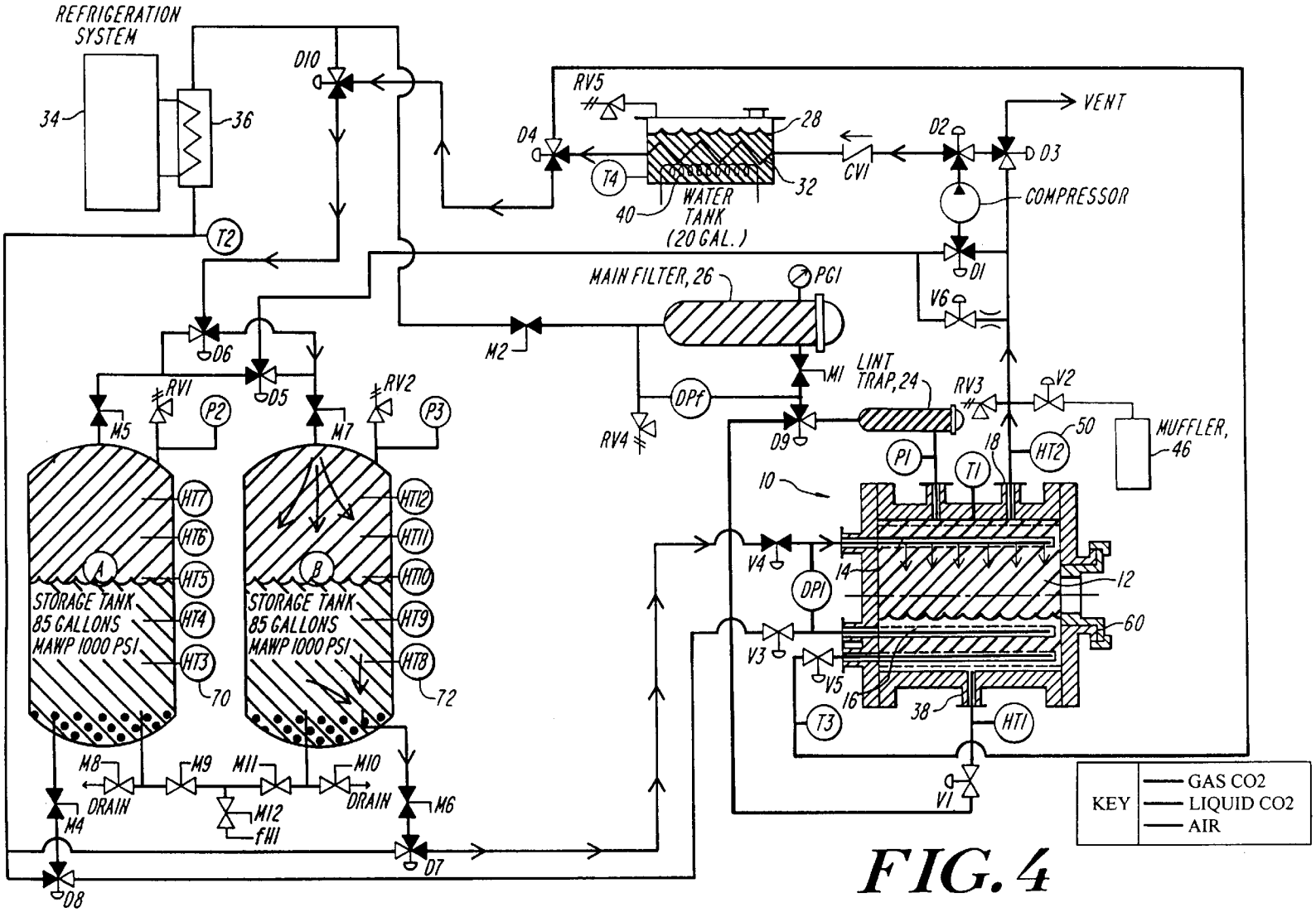
FIG. 4 is a schematic illustration of the system of FIG. 1 during an alternative cleaning chamber filling step in accordance with an embodiment of the present invention.

FIG. 4 schematically illustrates an alternative step of filling cleaning chamber 10 with liquid $CO_2$ from storage tank 22. In this alternative step, gaseous $CO_2$ is drawn from top opening 18 of cleaning chamber 10 and is pushed by compressor 30 to the top of storage tank 22. This forces liquid $CO_2$ out of the bottom of the storage tank 20 into bottom opening 38 of cleaning chamber 10 until the chamber is completely filled with liquid $CO_2$, as described above with reference to FIG. 3. Complete filling of cleaning chamber 10 may be determined by a timer (not shown) and/or by sensor 50 at the exit of cleaning chamber 10 and/or by a level sensor 72 associated with storage tank 22. Because the arrangement of tanks 20 and 22 is generally symmetrical, either storage tank 20 or 22 may be used for the initial filling of cleaning chamber 10.

After completely filling cleaning chamber 10, the articles within chamber 10 may be agitated by a periodically continuous jet inflow of liquid $CO_2$ provided through either port arrangement 14 or 16. In a preferred embodiment of the invention, port arrangements 14 and 16 are used alternately, to provide alternate clockwise and counter-clockwise agitation cycles. In this embodiment, port arrangement 14 may be used only for supplying liquid $CO_2$ from storage tank 22 and port arrangement 16 may be used only for supplying liquid $CO_2$ from storage tank 20, as described below. The length of time of each agitation cycle may correspond to the amount of $CO_2$ in storage tanks 20 and 22, whereby the direction of agitation may be reversed each time the level of $CO_2$ in the storage tank being used drops below a predetermined, low, level. This level may be detected by level sensors 70 or 72 of storage tanks 20 or 22, respectively. The jet agitation causes rotation of the articles being cleaned in chamber 10, as is known in the art.

Figure 5A:
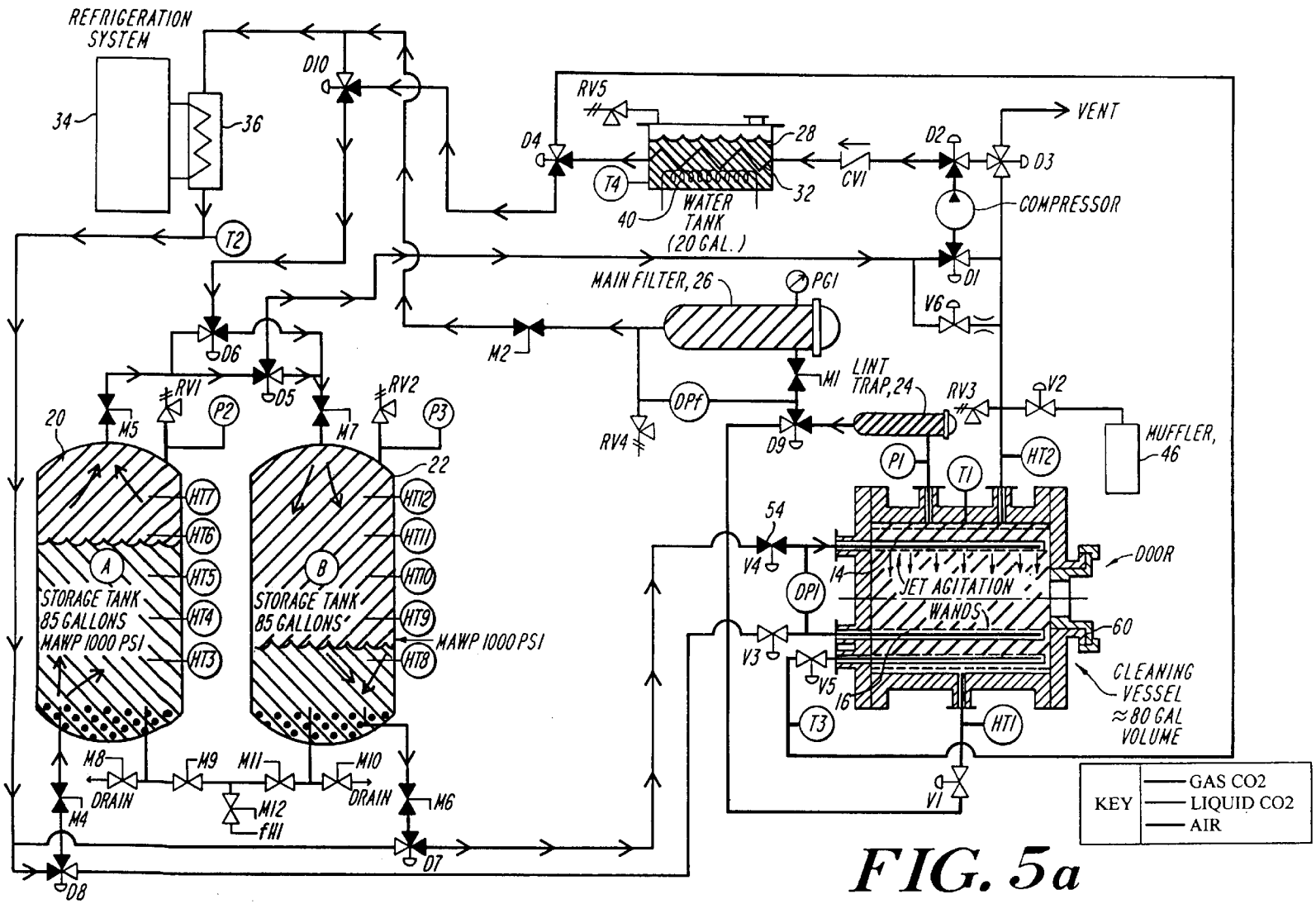
FIG. 5A is a schematic illustration of the system of FIG. 1 during a jet agitation step of a dry-cleaning process in accordance with an embodiment of the present invention.

FIG. 5A schematically illustrates jet agitation via port arrangement 14. In this alternative, gaseous $CO_2$ is drawn from the top of storage tank 20 and is pushed by compressor 30, via heat exchanger 32, into the top of storage tank 22. This forces liquid $CO_2$ out of the bottom of storage tank 22 via a valve 54 into port arrangement 14, for example, two hollow wands located diametrically opposite each other in cleaning chamber 10 and each having a plurality of jet inflow ports. Excess fluid is continuously recycled, via lint trap 24 and filter 26, via heat exchanger 36 of refrigeration system 34, back into storage tank 20. This produces a substantially continuous flow of liquid $CO_2$ via cleaning chamber 10.

Figure 5B:
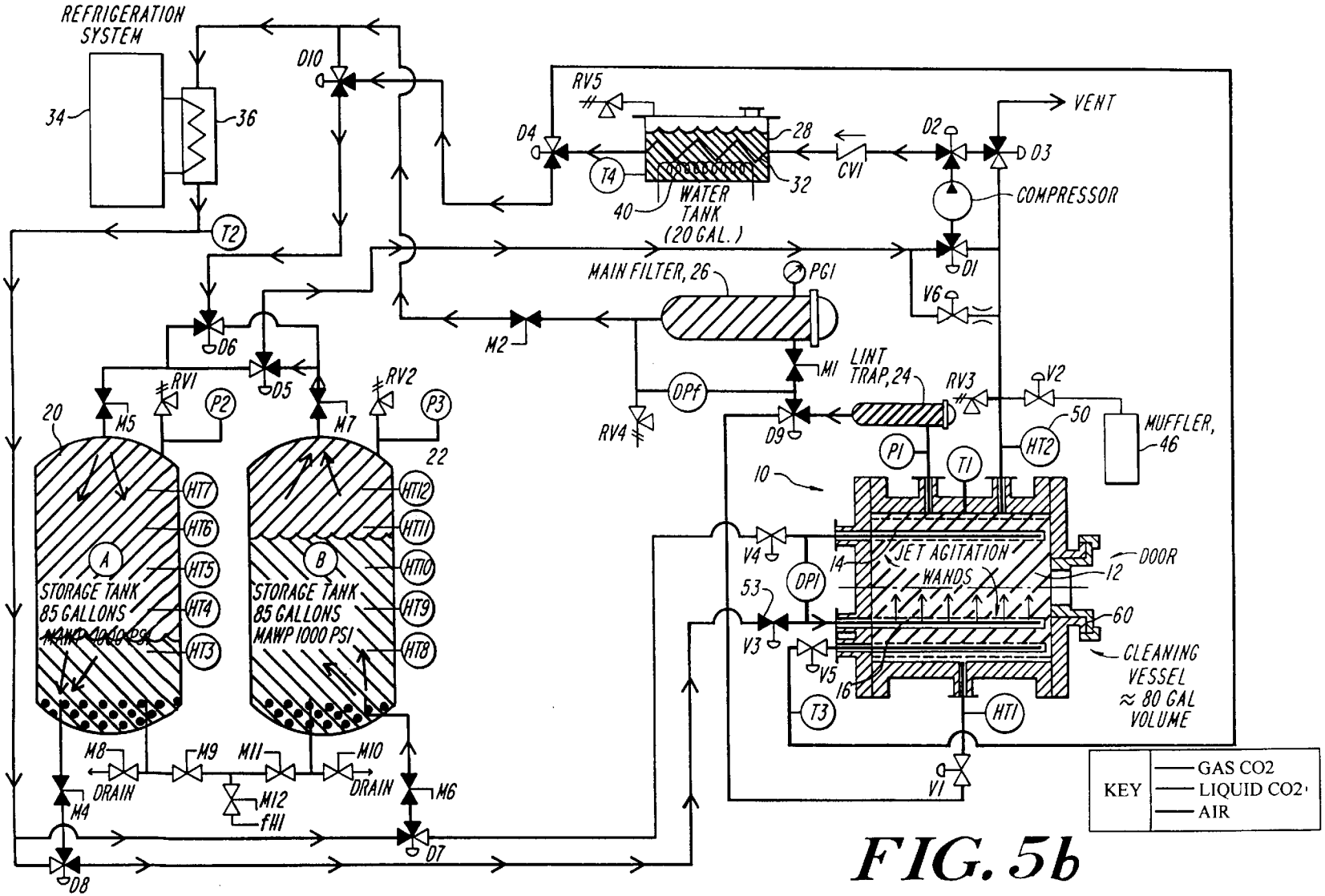
FIG. 5B is a schematic illustration of the system of FIG. 1 during an alternative jet agitation step in accordance with an embodiment of the present invention.

FIG. 5B schematically illustrates jet agitation via ports 16. In this alternative, gaseous $CO_2$ is drawn from the top of storage tank 22 and is pushed by compressor 30, via heat exchanger 32 in water bath 28, into the top of storage tank 20. This forces liquid $CO_2$ out of the bottom of storage tank 20 via a valve 53 into ports 16, for example, two hollow wands located diametrically opposite each other in cleaning chamber 10 and each having a plurality of jet inflow ports. Excess fluid is recycled, via lint trap 24 and filter 26, and optionally via heat exchanger 36 of refrigeration system 34, back into storage tank 22.

Figure 6A:
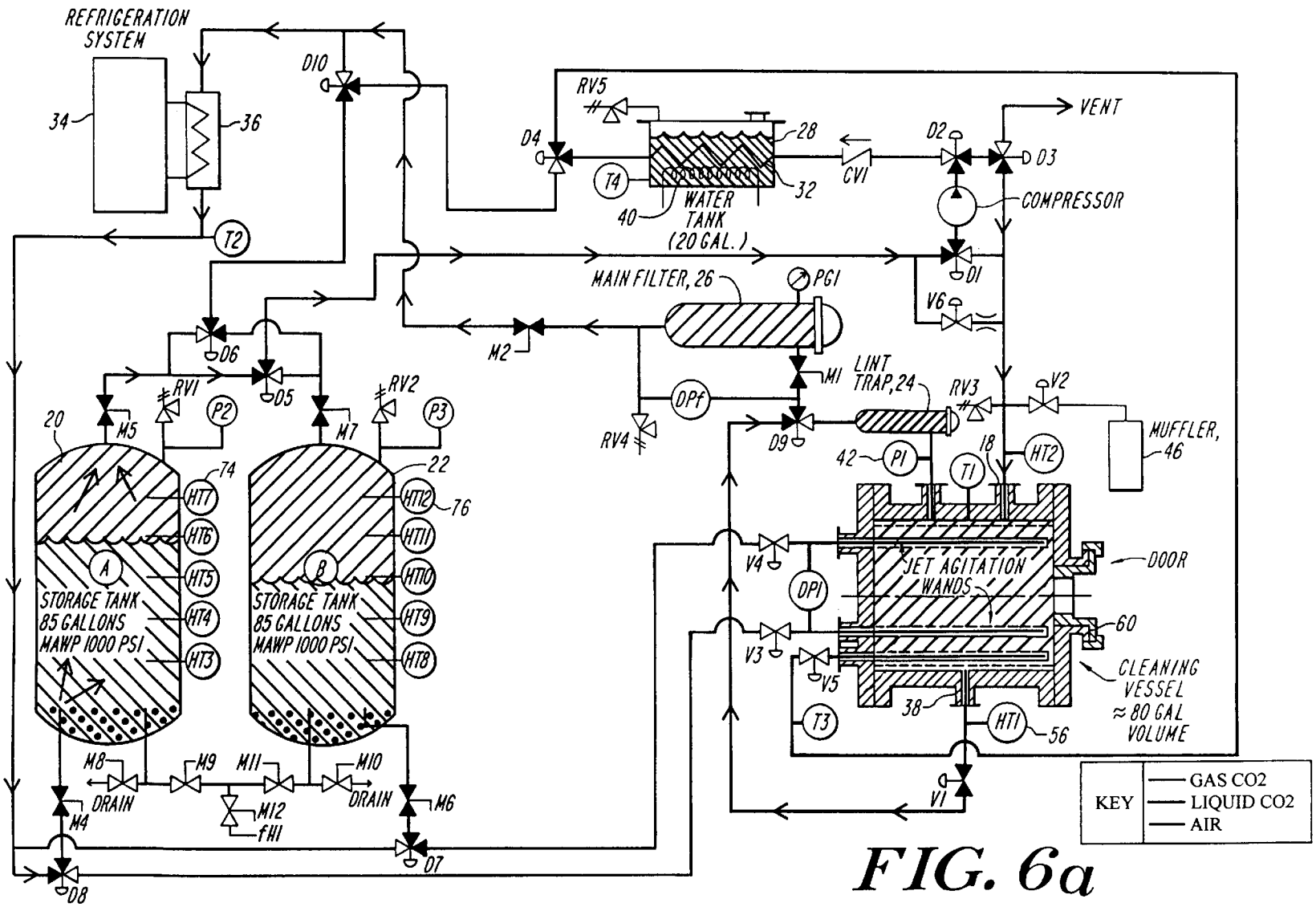
FIG. 6A is a schematic illustration of the system of FIG. 1 during a cleaning chamber draining step of a dry-cleaning process in accordance with an embodiment of the present invention.

After agitation as described above, used/contaminated liquid is drained from cleaning chamber 10 into the bottom of either storage tank 20 or storage tank 22, depending on the level of $CO_2$ in each tanks. Generally, cleaning chamber 10 is drained into the storage tank supplying liquid $CO_2$ for the last agitation cycle, because the last-used storage tank is at its minimum level at the end of last agitation cycle. FIG. 6A schematically illustrates draining of used/contaminated liquid into storage tank 20. Clean gaseous $CO_2$ is drawn from the top of storage tank 20 and is pushed by compressor 30 into top opening 18 of cleaning chamber 10. This forces the used/contaminated liquid $CO_2$ out of bottom opening 38 of the cleaning chamber, via filter 26 and heat exchanger 36 of refrigeration system 34, into the bottom of storage tank 20. Thus, filtered and cooled liquid flows into storage tank 20. The flow stops when a level sensor 74 indicates a predetermined fluid level in storage tank 20 or when a low level sensor 56 associated with cleaning chamber 10 indicates that the cleaning chamber is empty.

Figure 6B:
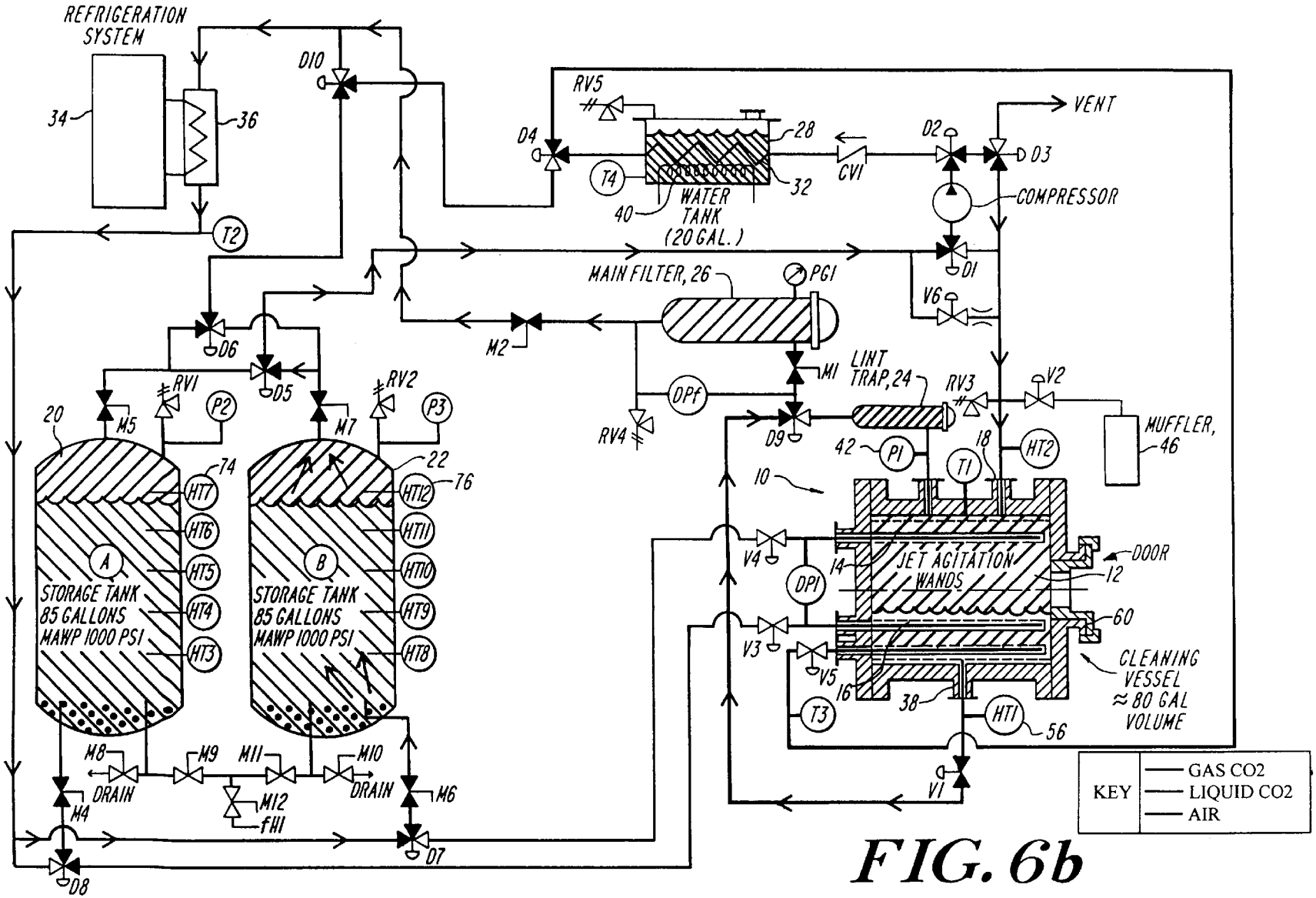
FIG. 6B is a schematic illustration of the system of FIG. 1 during an alternative cleaning chamber draining step in accordance with an embodiment of the present invention.

FIG. 6B schematically illustrates draining of used/contaminated liquid into storage tank 22. Clean gaseous $CO_2$ is drawn from the top of storage tank 22 and is pushed by compressor 30 into top opening 18 of cleaning chamber 10. This forces the used/contaminated liquid $CO_2$ out of bottom opening 38 of the cleaning chamber, via filter 26 and heat exchanger 36 of refrigeration system 34, into the bottom of storage tank 22. Thus, filtered and cooled liquid flows into storage tank 22. Drainage is terminated when cleaning chamber 10 as detected, for example, by low level sensor 56 or by a level sensor 76 associated with storage tank 22.

Figure 7:
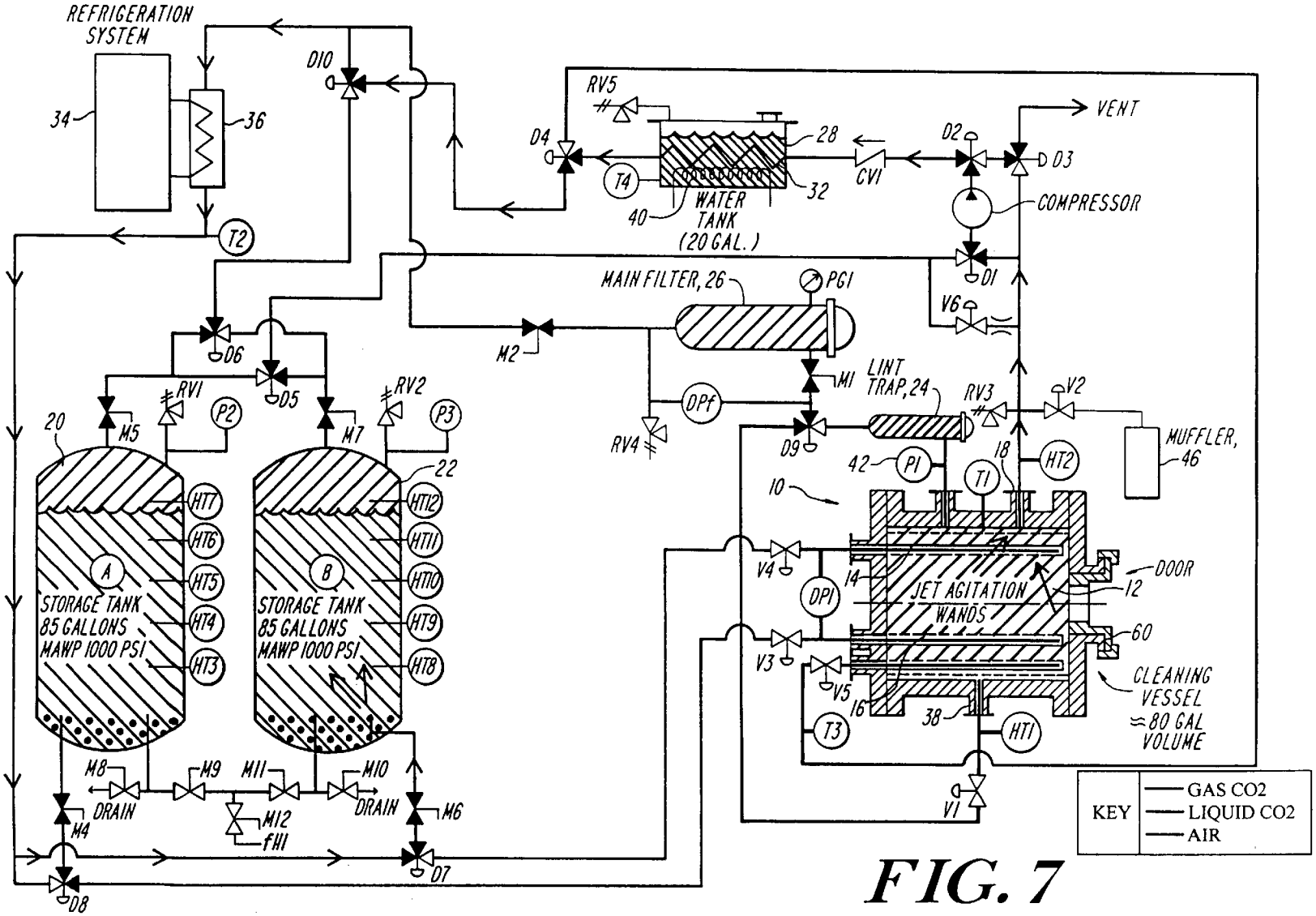
FIG. 7 is a schematic illustration of the system of FIG. 1 during a pressure recovery step of a dry-cleaning process in accordance with an embodiment of the present invention.

FIG. 7 schematically illustrates a vapor recovery step in accordance with an embodiment of the dry-cleaning process of the present invention. This step is required in order to recover $CO_2$ vapor remaining in cleaning chamber 10 after the drainage described above. Gaseous $CO_2$ is drawn from top opening 18 of cleaning chamber 10 and is pushed by compressor 30, via heat exchanger 32 in water bath 28, where the $CO_2$ is somewhat cooled, into heat exchanger 36 in refrigeration system 34. This cools and condenses the $CO_2$ back into a liquid state. The liquid $CO_2$ then flows into storage tank 20 and/or 22. The flow stops when the pressure in cleaning chamber 10, as measured by pressure transducer 42, drops below a predetermined threshold, for example, 50 psi.

Figure 8:
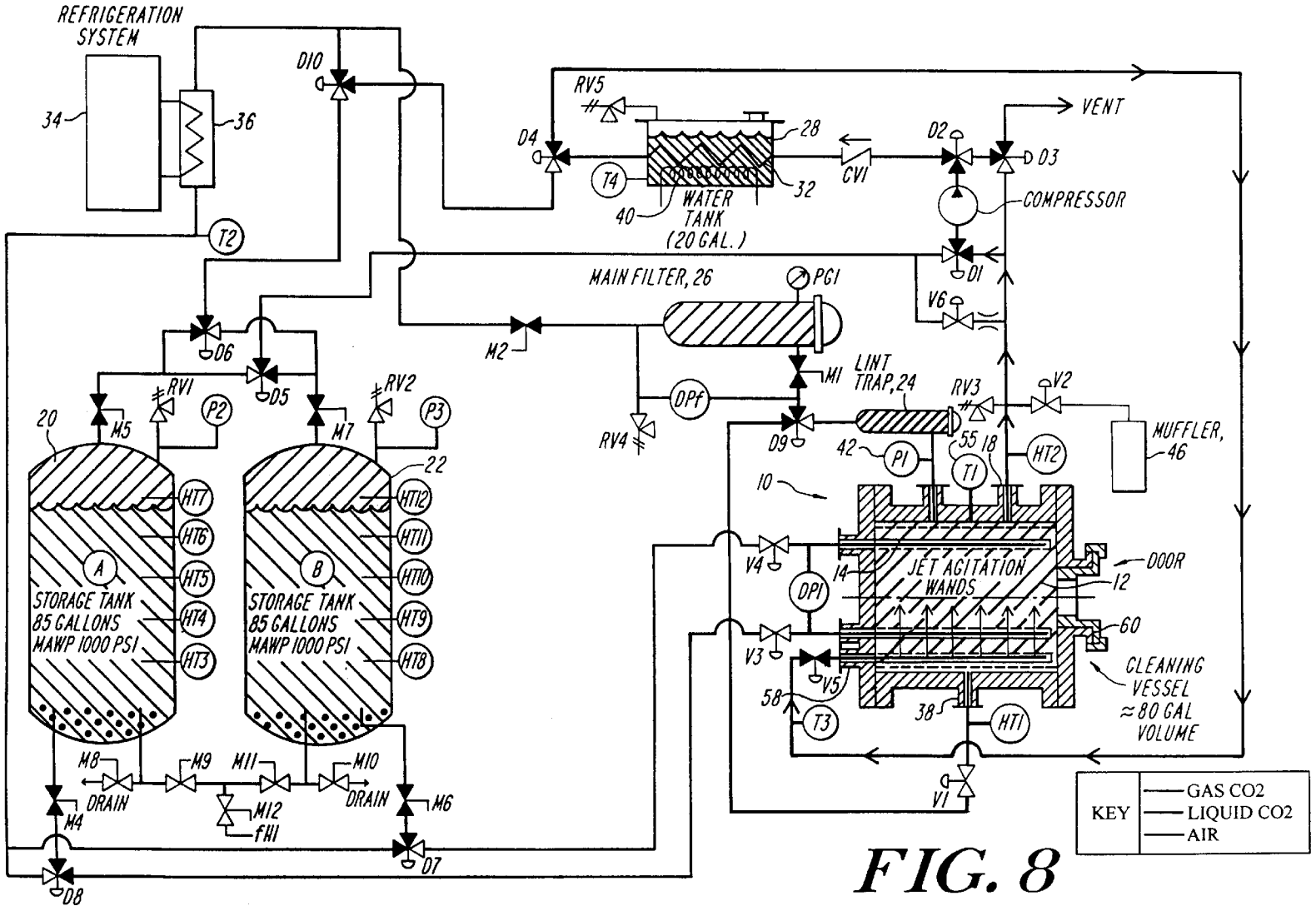
FIG. 8 is a schematic illustration of the system of FIG. 1 during a cleaning chamber warm-up step of a dry-cleaning process in accordance with an embodiment of the present invention.

FIG. 8 schematically illustrates a cleaning chamber warm-up step of the dry-cleaning process in accordance with an embodiment of the of the present invention. This step is implemented to warm-up the interior cleaning chamber 10 and the articles therein, thereby to prevent water ice formation due to vapor recovery. In an embodiment of the present invention, vapor recovery as described above continues until a first predetermined temperature is reached, for example, 35–40° F., as measured by a temperature sensor 55. At this point warm-up begins and remains in effect until a second predetermined temperature is reached, for example, a temperature greater than 50° F. which may also be measured by sensor 55. After the warm-up step, a final vapor recovery may be resumed. For example, the dry-cleaning process summarized in FIG. 10 includes two vapor recovery steps, 3 minutes and 5 minutes, respectively, separated by a two minute warm-up step. The warm-up step may be performed as follows. gaseous $CO_2$ vapor is drawn from top opening 18 of cleaning chamber 10 and is pushed by compressor 30, via heat exchanger 32 in water bath 28, where the $CO_2$ is heated, into a side opening 58 of cleaning chamber 10. The heated $CO_2$ warms-up cleaning chamber 10.

FIG. 9 schematically illustrates a cleaning chamber venting step of the dry-cleaning process in accordance with an embodiment of the of the present invention. This step is implemented to vent the cleaning chamber of remaining $CO_2$ vapor pressure so that a door 60 of the cleaning chamber may be opened and the clean articles may be removed. In an embodiment of the present invention, the remaining $CO_2$ vapor, which may be at a pressure of about 50 psi, may be released either to the system surroundings, via sound control muffler 46, or outdoors via a venting pipe 62.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A dry-cleaning system for cleaning articles comprising:

first and second storage tanks for storing carbon dioxide ($CO_2$);

a cleaning chamber having jet ports;

a compressor for establishing a pressure differential between said first and second storage tanks to transport a predetermined amount of liquid $CO_2$ between said first and second storage tanks via said jet ports and through said cleaning chamber, to provide jet agitation in said cleaning chamber;

a refrigeration system disposed in selective fluid communication with said cleaning chamber and said first and second storage tanks for cooling fluid $CO_2$ prior to introduction of said fluid $CO_2$ into one of said first and second storage tanks; and a heat exchange module disposed in selective fluid communication with said cleaning chamber, said first and second storage tanks, and said refrigeration system for selectively cooling gaseous $CO_2$ flowing between said cleaning chamber and said refrigeration system and for warming gaseous $CO_2$ from said cleaning vessel prior to reintroduction of said warmed gaseous $CO_2$ into said cleaning vessel.

2. A system according to claim 1 wherein the compressor is capable of raising the pressure in either of said first and second storage tanks to at least 750 PSI.

3. A system according to claim 2 wherein the compressor is capable of raising the pressure in either of said first and second the storage tanks to about 900 PSI.

4. A system according to claim 1 wherein the compressor is capable of lowering the pressure in the cleaning chamber to less than 150 PSI.

5. A system according to claim 4 wherein the compressor is capable of lowering the pressure in the cleaning chamber to about 50 PSI.

6. A system according to claim 1 wherein the compressor comprises an oil-less compressor.

7. The system according to claim 1 wherein said heat exchange module comprises an electric heater.

8. The system according to claim 7 wherein said heat exchange module further comprises:

a fluid conduit for conveying said fluid $CO_2$ through said heat exchange module; and a liquid bath, said electric heater being disposed in said liquid bath for selectively heating liquid contained therein, and said fluid conduit being disposed in said liquid bath for exchanging thermal energy between said liquid bath and said fluid $CO_2$.

* * * * *